United States Patent [19]

Haynes

[11] Patent Number: 4,511,168

[45] Date of Patent: Apr. 16, 1985

[54] SLIP MECHANISM

[75] Inventor: Charles W. Haynes, Spring, Tex.

[73] Assignee: Joy Manufacturing Company, Pittsburgh, Pa.

[21] Appl. No.: 464,521

[22] Filed: Feb. 7, 1983

[51] Int. Cl.[3] ..... E21B 19/07

[52] U.S. Cl. ..... 294/102.2; 188/67

[58] Field of Search ..... 294/90, 102 R, 102 A; 188/67

[56] References Cited

U.S. PATENT DOCUMENTS

| | | | |
|---|---|---|---|
| 1,555,379 | 9/1925 | Moody | 188/67 |
| 1,664,461 | 4/1928 | Montgomery | 294/102 A |
| 2,063,378 | 12/1936 | Hiniker | 188/67 |
| 2,156,384 | 5/1939 | Fluellen | 175/422 |
| 2,575,649 | 11/1951 | Abegg | 188/67 |
| 2,612,671 | 10/1952 | Martin | 188/67 |
| 2,641,816 | 6/1953 | Liljestrand | 188/67 |
| 3,149,391 | 9/1964 | Boster | 294/102 A |
| 3,270,389 | 9/1966 | Kingsbury | 188/67 |
| 3,342,520 | 9/1967 | Haynes | 294/90 |
| 3,846,877 | 11/1974 | Spiri | 188/67 |
| 4,275,488 | 6/1981 | Gray | 294/102 A |
| 4,332,062 | 6/1982 | Byrne | 188/67 |
| 4,361,940 | 12/1982 | McFadden | 188/67 |

FOREIGN PATENT DOCUMENTS

| | | | |
|---|---|---|---|
| 694575 | 9/1964 | Canada | 294/102 A |

*Primary Examiner*—Johnny D. Cherry

*Attorney, Agent, or Firm*—Edward L. Levine

[57] ABSTRACT

Slip mechanisms for selectively gripping and releasing conduit in a well drilling operation, particularly useable as elevators or spiders. Three slips are positioned within a tapered bore of the slip mechanism having a split front opening, and are articulatingly suspended from a vertically movable ring. Upon lowering of the ring the slips move downwardly and inwardly along the tapered bore to simultaneously and evenly grip the conduit. Upon raising of the ring the slips move upwardly and outwardly along the tapered bore and disengage from the gripped conduit. In the disengaged position two of the three slips are circumferentially slidable, through the suspension connection to the ring, to a position spaced from the front opening and adjacent the third slip, whereby the slip mechanism is laterally movable from, or about, the conduit. A funnel shaped guide skirt is mountable on the bottom of the mechanism when operation as an elevator is desired.

12 Claims, 13 Drawing Figures

SLIP MECHANISM

BACKGROUND OF THE INVENTION

This invention relates to oil field drilling apparatus and more particularly provides a slip mechanism of the type functioning as an elevator or a spider.

Elevators or spiders are well known for use during the lowering or raising of conduits, such as drill pipe, tubing and casing, into and out of a well bore during drilling operations. The elevator or spider can include slips having teeth which engage the casing so that the casing is not inadvertently released into the well bore.

Such slip mechanisms include primary components which are arranged in several basic configurations. The main structure is the slip bowl or body which is generally an enlarged support structure having an internal tapered bore. Slip elements are disposed within the bore and when allowed to fall under the force of gravity, wedge radially against the casing so as to prevent the casing from slipping downwardly. Typically, known assembly structures do not engage the casing or other conduit in a balanced manner, which can unevenly load and damage the casing or limit the gripping force. Raising of the slip elements generally releases the gripping interaction.

The slip mechanisms typically include a structural arrangement which provides a radial opening through the body to allow lateral motion of the slip mechanism onto, or away from, the casing. One such arrangement utilizes a hinged body whereby the body is composed of two or more sections which are hinged together. Another such arrangement utilizes a unitary body of the so called box type which includes a hingedly attached door.

Exemplary of the hinged body design are mechanisms manufactured by Varco International, Inc. and referred to as slip type "SL" casing elevator/spiders. Such units include a body formed in two halves cooperably joined by large hinge pins. Four slips are positioned about the central bore in oppositely disposed pairs, which can disadvantageously result in an unbalanced loading between the two pairs upon gripping of the casing. Exemplary of the unitary body type are those manufactured by Byron Jackson Tools, Inc. which include a double hinged door. This design appears to use three slips which do not overlap the radial opening in the unitary body and which consequently eccentrically surround the casing both prior to engaging the casing and upon gripping and setting of the slips.

Additional slip type structures are known. For example, U.S. Pat. No. 2,641,816 discloses a pneumatically or hydraulically operated power slip including a fabricated slip lift ring having a single hinge gate. Three slip segments are hinged together by pins and are individually connected to arms which slide along trackways in the ring to engage or disengage the slips from a drill pipe. The slips are lifted and moved radially away from the pipe upon lifting of the ring, and fall into a gripping position under the influence of gravity upon lowering of the ring. The three hingedly connected slip segments may be manually moved together to one side of a tapered area or slip bowl upon disengagement from the pipe.

An automatic drill slip unit is disclosed in U.S. Pat. No. 2,575,649 including two ringlike members rotatably interconnected one inside the other and having throats which are registrable to allow placement about a drill pipe. Three slips are suspended from the inner ring by mechanical links. The inner ring is lowered through lifting of a counterweight such that the slips slide along tapered faces of a slip bowl and engage the drill pipe.

A slip type elevator or spider having a hinged door is disclosed in U.S. Pat. No. 3,149,391 including an assembly of three slip elements which are interconnected through vertical pivot pins. Torsion springs positioned about the pins bias the slip elements toward an open position upon lifting of the elements under the influence of a pivoting arm and yoke whereby camming projections on the rear surface of the slips nest into annular depressions of the elevator body.

Another slip type pipe elevator is disclosed in U.S. Pat. No. 3,342,520 having a one-piece generally circular body and three slips carried by cam follower pins mounted on rollers which, upon rotation of an annular plate by an extending manually gripped handle, rise up a sloping cam surface to lift and disengage the slips. The slips withdraw upwardly and radially outward to allow for positioning of the elevator over the upper end of the pipe.

A power driven slip structure is disclosed in U.S. Pat. No. 3,270,389 wherein three slips are separately supported from a body or ring which is raised and covered or laterally swung into position by a fluid powered mechanism. The ring includes a rotatable slip carrier. The slips can also be hinged to one another through vertical hinge pins. The ring includes a main section and a hinged gate section. The central slip is rigidly connected to a support part extending from the slip carrier having a cam slot which guides radial motion of the slip, and the other slips are mounted to two hanger elements suspended from the rotatable carrier having ball ends to form a universal joint type connection to the slips.

Slips for supporting drill pipe in a bowl are also shown in U.S. Pat. No. 4,332,062 which discloses a bowl made of four sections forming an inverted pyramidal opening and having a slip associated with each of the four sections. The slips are connected to an hydraulically actuated lift ring which simultaneously lowers the four slips into an engaged position against the drill pipe.

Further background on spider and slip type structures is provided in U.S. Pat. Nos. 2,063,378; 2,156,384 and 3,846,877.

While many of the discussed structures will operate to perform their intended purposes, improvement can be made. Certain of the structures, for example, require a complex or awkward sequence to properly position and operate. Others in practice unevenly load the pipe, casing or other type of conduit, causing excessive localized stress and wear. Other deficiencies exist. It is therefore desirable to provide a slip mechanism, operable as an elevator or spider, which alleviates prior deficiencies. Such mechanism should preferably be highly reliable, relatively simple to operate, and should alleviate undue stresses imposed upon the conduit being supported, particularly where the conduit is relatively thin walled casing. Such mechanism should provide balanced engagement of a conduit.

SUMMARY OF THE INVENTION

This invention provides a slip type mechanism useful as an elevator or a spider in a drilling operation, and particularly useful for casing operations. The mechanism provides for balanced gripping of a conduit by the slip elements. In one preferred form the mechanism includes a unitary body with a central tapered bore and a split section sufficiently large to allow the mechanism to be moved radially into a working position with the bore about the casing. Traversing the split section is a door which is hinged at both ends to the body and which, when locked in place, joins with the body to completely surround the casing.

Mounted atop the body is a lift ring having a split region aligned with the split section of the body. Pivotally suspended from the ring are three slip elements. The attachment and configuration of the three slip elements with respect to the ring allow two of the elements to be readily moved circumferentially along the ring upon disengagement of a quickly releasable gripping mechanism. The third slip element can also be circumferentially movable or circumferentially fixed in place opposite the split section. The two circumferentially slidable elements can be moved into a position adjacent the third element, allowing the split section to be fully open for positioning about, or removal from, the casing.

The ring is actuable to simultaneously raise or lower the attached slip elements. For engagement, the three slips slide downwardly and inwardly, guided by the tapered bore, and simultaneously engage the conduit in balanced contact providing substantially equal load distribution among the slips. The force applied to lift the ring can be provided in many manners, and a foot assisted configuration is preferred. Camming surfaces between the body and the slip elements guide the elements radially into contact with the casing or outwardly from the casing as the lift ring and slip elements are respectively lowered or raised. Simultaneous contact with the casing by the three slip elements insures that stresses on the casing resulting from eccentric or uneven loading are alleviated.

BRIEF DESCRIPTION OF THE DRAWINGS

The advantages, nature and additional features of the invention will become more apparent from the following description, taken in connection with the accompanying drawings, in which.

DESCRIPTION OF THE PREFERRED EMBODIMENTS

Figure 1:
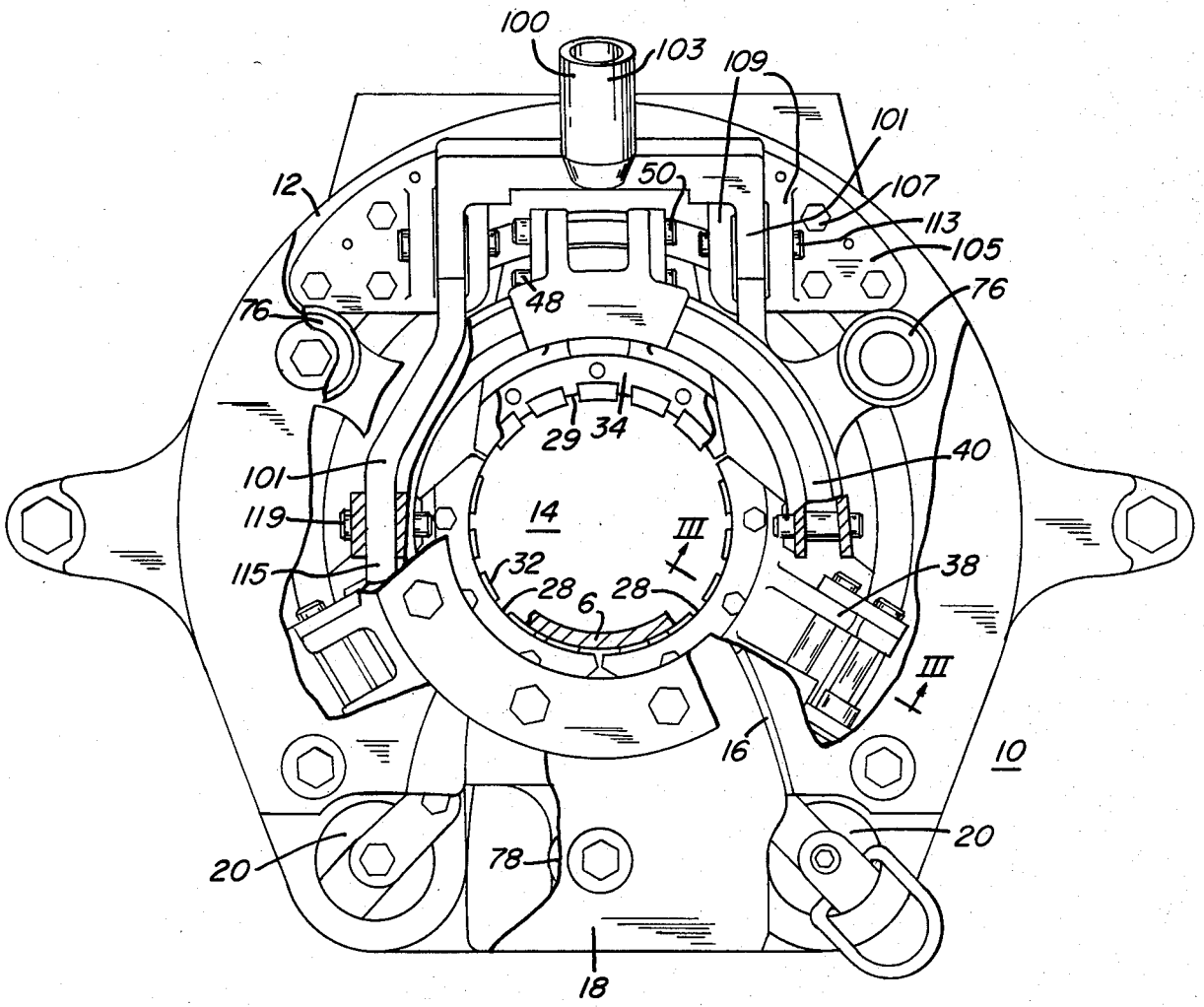
FIG. 1 is a top view of a slip type elevator-spider mechanism in accordance with the invention having certain of the component structures broken away.
Figure 2:
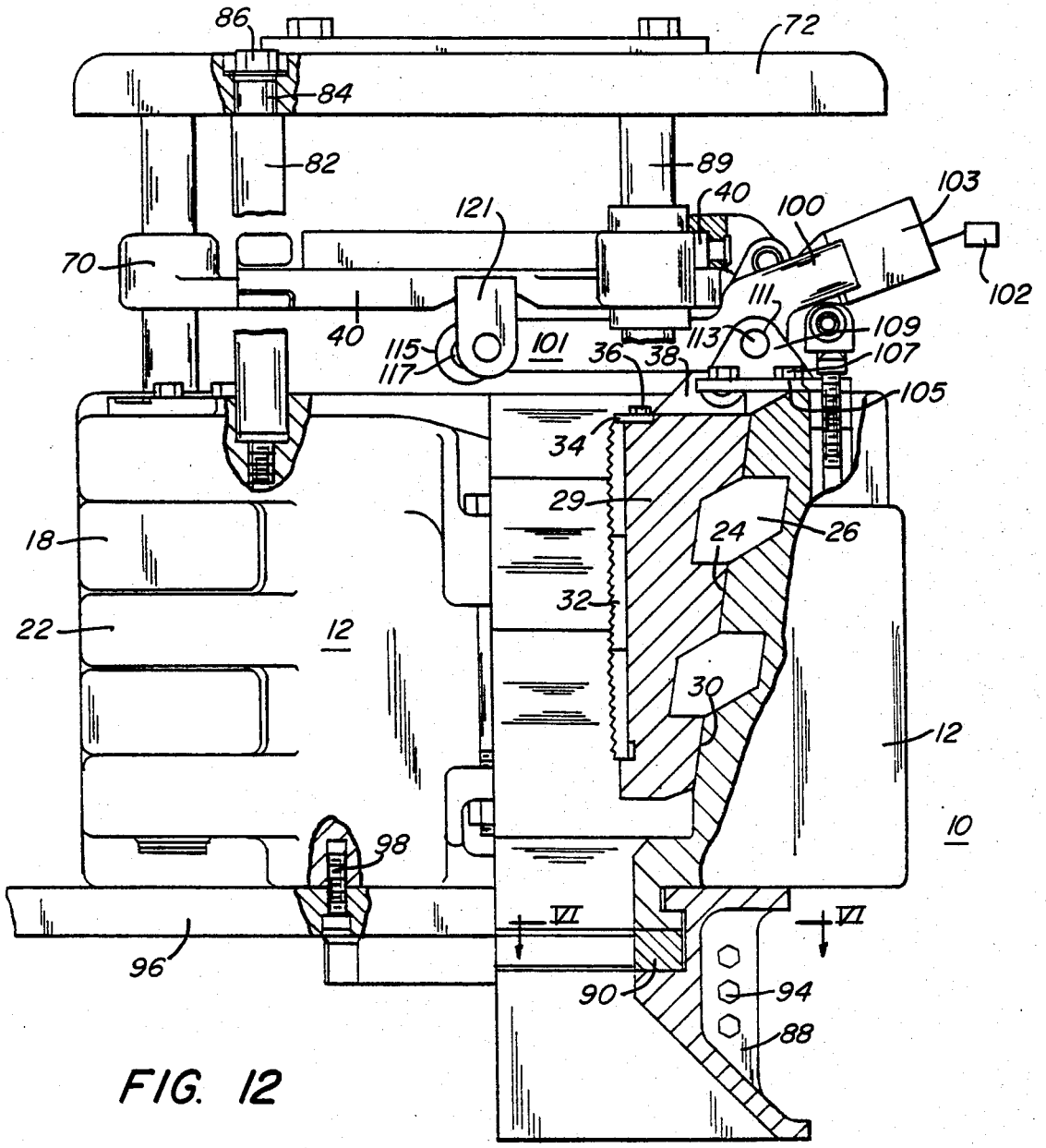
FIG. 2 is a side elevation view of the mechanism of FIG. 1, partially in section.

Referring now particularly to FIGS. 1 and 2, there is shown a slip type mechanism 10 selectively useful during well drilling operations as either an elevator having a guide skirt and lifting eyes or hooks for suspension from a traveling block and hook, or as a spider having a base plate for placement upon the rotary table of a drilling rig. The mechanism 10 includes a body 12 having a central bore 14 and a split section 16 extending from the bore 14 radially through the body 12.

A door 18 is compatably sized and configured to fit within the split section 16. The door 18 is hingedly connected, by hinge pins 20 which pass through each end of the door and through ears 22 of the body 12 at each side of the split section 16. The split section 16 and the door configuration are sized sufficiently large to allow for radial positioning of the mechanism 10 about, or away from, the rod, pipe, casing or other conduit 6 being utilized.

The bore 14 is tapered inwardly from top to bottom, and includes a plurality of contact surfaces 24 and indentures 26. Three slip assemblies are disposed at least partially within the bore 14, including two side slips 28 and a rear slip 29, each including camming surfaces 30 which slide downwardly and inwardly along the contact surfaces 24 of the body 12 for gripping a casing 6, and which partially nest in the indentures of the bore 14 upon upwardly and radially outward movement during the release from the casing. Each slip 28, 29 includes replaceable gripping teeth elements 32, partially supported along the face of the slip by a support ring 34 affixed to each slip 28 by a plurality of bolts 36. The elements 32 and slips interconnect through dovetail joints. The slips 28, 29 include integrally formed slip brackets 38 for connecting the slips 28, 29 to a slip ring 40. The slips are preferably equal in configuration and arcuate extension, each defining an arc of approximately one hundred twenty degrees.

Figure 3:
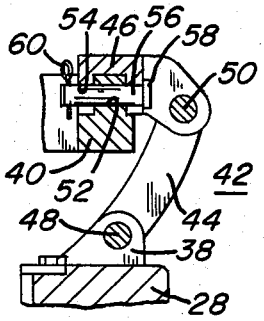
FIG. 3 is a partial section view taken at III—III of FIG. 1.

As shown best in FIG. 3, the slips 28, 29 are individually connected to the slip ring 40 through a dual pivot interconnection 42. The interconnection 42 allows articulation between the slip ring 40 and the slips 28, 29 upon vertical motion of the slip ring 40. Upward or downward motion of the slip ring 40 correspondingly raises or lowers the slips 28, 29 in a balanced manner. A slip ring link 44 is disposed between the slip brackets 38 and slip ring brackets 46, and is pivotally mounted to the brackets 38, 46 respectively by a slip bracket clevis pin 48 and a slip body clevis pin 50. The interconnection 42 and the slips are configured such that the slips in the unrestrained position would tend to articulate in a radially outward direction.

Figure 4:
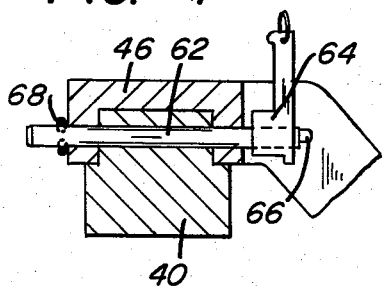
FIG. 4 is a view of an alternative configuration, similar to the structure of FIG. 3.

The slip ring 40 can be of any convenient configuration, and preferably is shaped in cross-section generally as an inverted T. The slip ring bracket 46 is cooperably sized and configured to selectively securely seat against the slip ring 40, and also to slide circumferentially along the slip ring 40 when not secured in place. The slip ring bracket preferably is channel shaped. The slip ring 40 and the slip ring bracket 46 each include a respective aperture 52, 54, which apertures are alignable to receive disconnectable means for securing the ring and the bracket, such as a locking pin 56. One form of locking pin 56 has an enlarged head 58 and a cotter pin 60. An alternative and preferred quickly releaseable interconnection is shown in FIG. 4, and utilizes a single acting ball lock pin 62 having a gripping surface 64 and an actuator shank 66. Locking balls 68 are readily released from a locking orientation by manual hand pressure, and the pin 62 is then removed to allow sliding motion of the interconnection 42 and side slips 28. In this configuration the raised and disengaged slips 28 are circumferentially slidable about the bore, and particularly to a position whereat the mechanism 10 can be removed from the conduit 6 through the split section 16.

Figure 5:
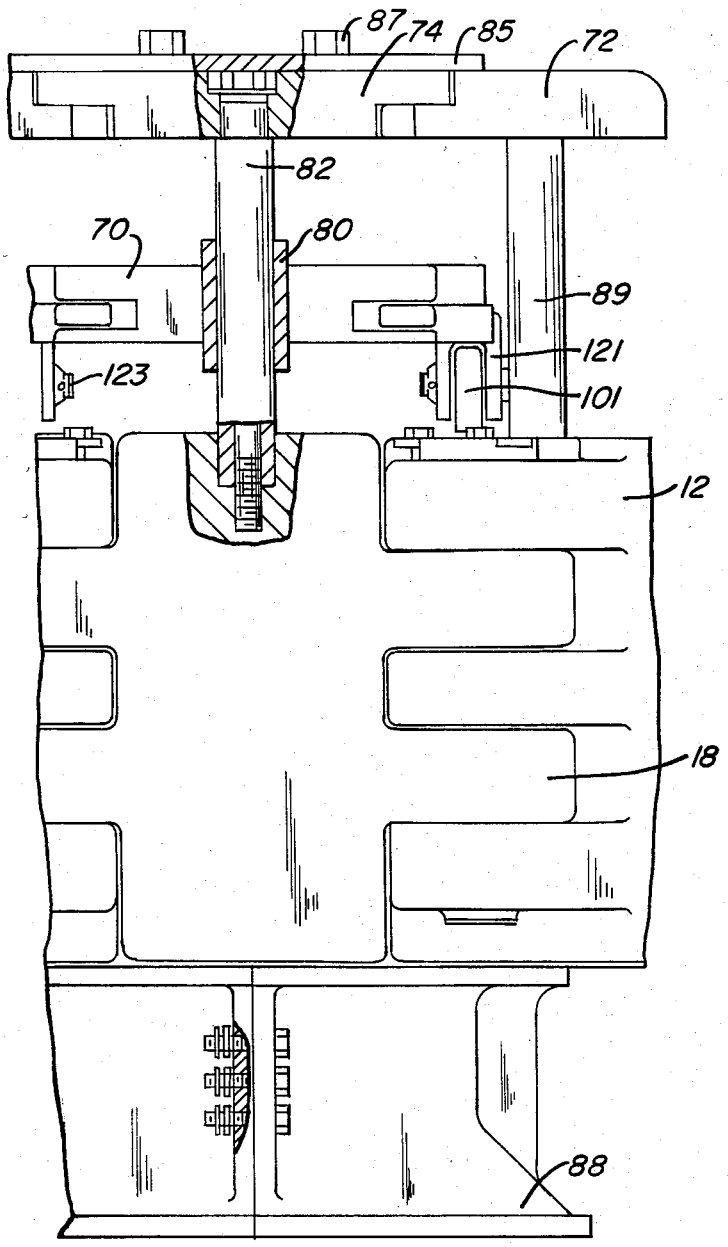
FIG. 5 is a frontal elevation view of the mechanism of FIG. 1, partially in section.
Figure 13:
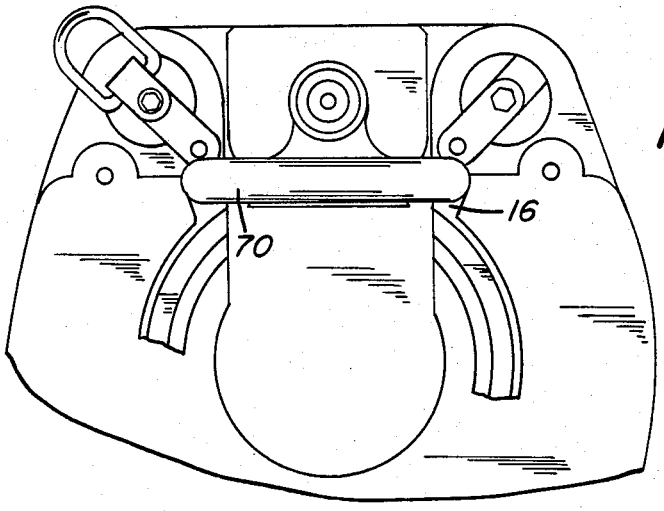
FIG. 13 is a plan view similar to FIG. 1 with certain components omitted for clarity.

The slip ring 40 extends in an arc above the body 12, terminating generally at the area of the split section 16 of the body. Mounted to the slip ring 40 through a sliding tongue in groove connection is a slip ring gate 70, shown best in FIGS. 5 and 13. Also shown in FIG. 5 is a cover 72 and a corresponding cover gate 74. The slip ring gate 70 and cover gate 74 are generally aligned with the door 18 so as to provide a passage into the bore 14 for placement about, or removal from, a casing 6. The cover gate 74 is affixed to the cover 72 through a guide ring 85 and bolts 87. The cover 72 is supported above the body 12 through two fixed posts 89 in conjunction with three guide posts 82.

The slip ring 40 has (FIG. 1) two guide post receivers 76 and the slip ring gate 70 also has a guide post receiver 78. The receivers 76, 78 are spaced approximately 120° apart. Referring again to FIGS. 2 and 5, the receivers are provided with bushings 80 to facilitate vertical sliding of each receiver along a guide post 82. The three guide posts 82 are respectively affixed to the body 12 and door 18 through an elongated bolt 84 which bears at its head 86 against the respective cover 72 or cover gate 74.

Figure 6:
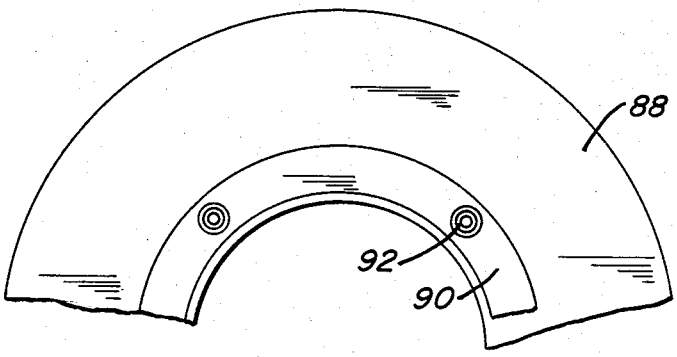
FIG. 6 is a plan view of a guide skirt and guide ring as viewed at VI—VI of FIG. 2.

FIGS. 2, 5 and 6 also show a split guide skirt 88 and guide ring 90 affixed to the slip mechanism 10 when the mechanism is to be used as an elevator. The guide skirt 88, guide ring 90, and fasteners 92 and 94 are not utilized when the mechanism 10 is to be used as a spider. When used as a spider, a base 96 is affixed to the body 12 by cap screws 98. The base 96 and screws 98 are not utilized when the mechanism is to be used as an elevator.

Referring to FIGS. 1, 2 and 5, the slip mechanism 10 includes a lifting yoke 100 which includes a generally U-shaped beam 101 and a handle 103. The yoke 100 cooperates with two pads 105, which are affixed to the body 12 by bolts 107. Each pad 105 has two pad eyes 109 having apertures 111. The pad eye apertures 111 are aligned with corresponding apertures of the yoke beam 101 such that a clevis pin 113 can be positioned through the apertures. The yoke 100 is thus pivotable about the clevis pins 113 such that upward or downward motion of the handle 103 moves the ends 115 of the yoke beam 101 in the direction opposite that of the handle. The ends 115 have internal camming apertures 117 which receive yoke pins 119 mounted between hangers 121 suspended from the slip ring 40. The camming apertures 117 allow vertical movement of the slip ring 40 upon pivotal movement of the yoke 100. Spring pins 123 maintain the yoke pins in position. The connecting configuration assures that the slips equally engage to grip the conduit.

Referring now to FIGS. 1, 2 and 7 through 11, a lower ear 125 extends from the yoke 100, generally at the region where the handle 103 is affixed to the beam 101, and contains an aperture alignable with apertures in a channel 127. A clevis pin 131 and cotter pin 133 arrangement provides a pivoting connection between the yoke 100 and a threaded stud 135 which is welded to the channel 127. The stud 135 is affixed to a locking rod 137. The threaded connection between the rod 137 and stud 135 allows for proper positioning of the components. The locking rod 137 is slidably positioned in a control slot 139 of the body 12. The rod 137 includes a locking notch 141 which is compatibly configured to a locking key segment 143 of a locking cam 145.

Figure 11:
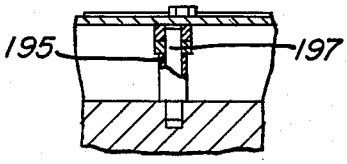
FIG. 11 is a section view taken at XI—XI of FIG. 8.

The locking cam 145 cooperates with other components hereinafter described, and pivots about the center of a grease fitting 147. The fitting 147 is supported by a bracket 149 affixed by fasteners 151 to the body 12. A heavy spring 153 is positioned between a pivotable spring housing 155 affixed to the body and another pivotable spring housing 157 affixed to a handle 159. FIG. 11 shows the position of a spring housing pin 197 mounted in a sleeve 195. The handle 159 also pivots about the center of the grease fitting 147. The handle 159 includes a grip 161 which protrudes through an arcuate slot 163 in a cover plate 165 affixed to the body by bolts 167. Affixed between the handle 159 and the locking cam 145 is a light spring 169. The linear force exerted on the locking cam 145 by the light spring 169 is substantially less than the force exerted by the heavy spring 153. Affixed rigidly to the handle 159 is a finger 171 which passes through a cammed opening 199 in the locking cam 145. The cammed opening is sized and configured such that the handle 159 is movable along a substantial portion of the arcuate slot 163 prior to the finger 171 abutting against the edge of the cammed opening 199. Subsequent to the abutment, continued movement of the handle 159 places a force on the locking cam 145 through the finger 171. In this manner spurious movement of the handle sufficient to effect the position of the cam 145 relative to the locking notch 141 is alleviated.

OPERATION

Figure 7:
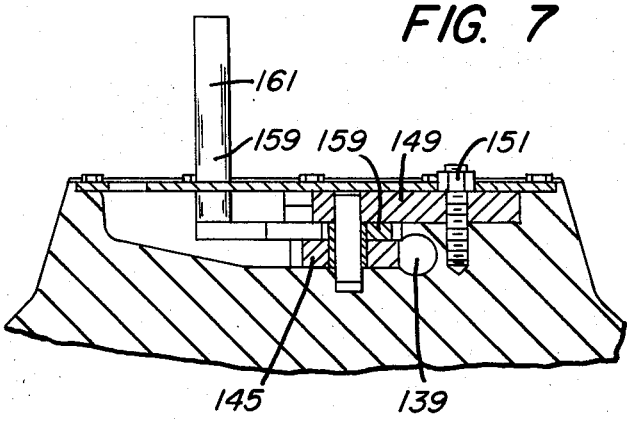
FIG. 7 is a sectional view taken at VII—VII of FIG. 8.
Figure 8:
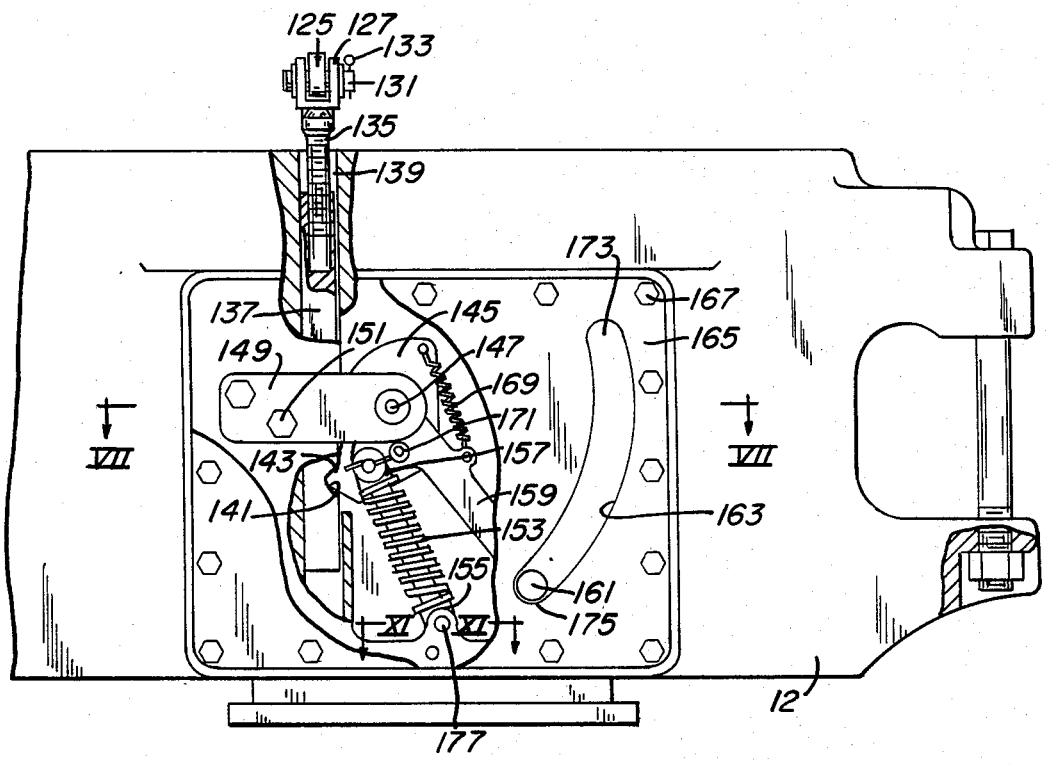
FIG. 8 is a rear elevation view of the mechanism of FIG. 1, partially broken away and partially in section.
Figure 9:
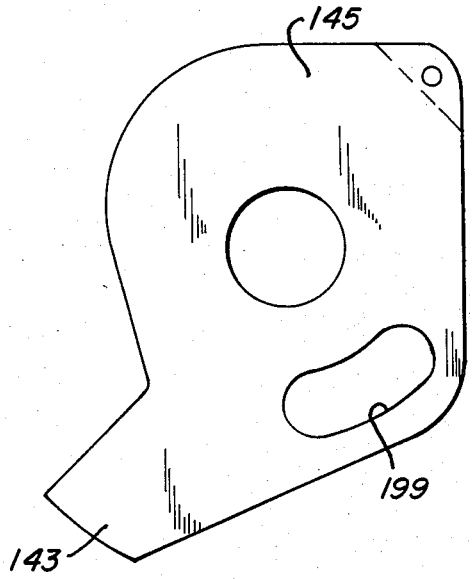
FIG. 9 is a plan view of a locking cam of the mechanism.
Figure 10:
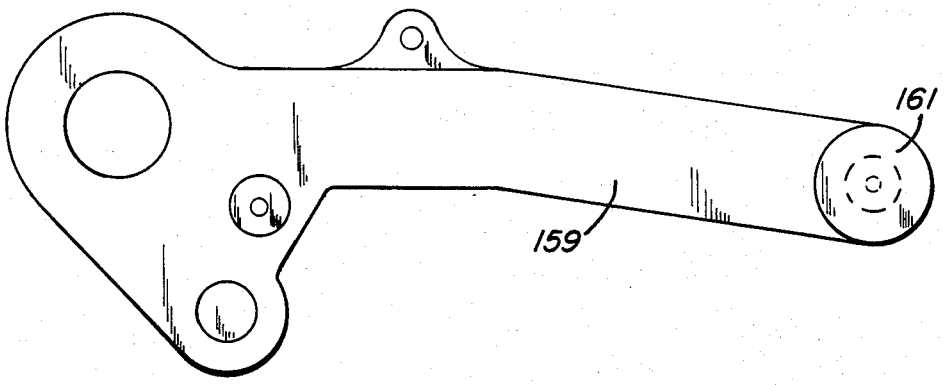
FIG. 10 is a plan view of a handle of the mechanism.

The Figures, with the exception of FIGS. 7 and 8, show the components of the mechanism 10 in the gripping orientation, that is, that position with the slips lowered into a position bearing against the casing or other conduit 6. FIGS. 7 and 8 show the locking mechanism in a latched orientation wherein the slips are up and disengaged from the casing. The mechanism allows rapid, reliable and simple removal of the slip elements 32 from the conduit, and a gravity assisted movement of the slips into an operational, equally engaged and balanced position.

From the engaged position shown in FIGS. 1 and 2, a downwardly directed force is applied, manually or mechanically, for example, by hydraulic or pneumatic drivers 102, to the handle 103 of the lifting yoke 100. The downward force on the handle causes the yoke to pivot about the clevis pins 113 such that the end 115 of the yoke opposite the handle rises along an arcuate path. The rising of the end 115 applies an upward force to the yoke pins 119, the hangers 121 and the slip ring 40. The slip ring is maintained in a horizontal orientation and confined to vertical movement by the guide post receivers 76, 78 sliding along the vertically oriented guide posts 82. The camming apertures 117 of the yoke assist in the transmission of arcuate motion of the yoke end to vertical motion of the slip ring.

Upward movement of the slip ring 40 pulls the slips 28, 29 upwardly, the force being transmitted through the pivoting interconnection (FIG. 3). The articulated motion between the slips and the slip ring, and the tapered configuration of the contact surfaces 24 and camming surfaces 30, causes the slips to slide upwardly and radially outward as the slip ring is raised, disengaging from the conduit. The camming surfaces 30 of the slips are raised to a nested position in the indentures 26 of the body 12.

With the slips raised, the operator reverses the securing connection between the slip ring 40 and the slip ring brackets 46, for example, by manually gripping the ball lock pin 62 (FIG. 4), pushing the actuator shank 66 to release the locking balls 68, and removing the pin from the apertures in the slip ring and bracket. Once the pin is removed, the bracket, and the attached slips, can readily be moved circumferentially along the ring 40. The rear slip 29 is maintained in position opposite the split section 16, and the side slips 28 are circumferentially moved toward the rear slip so as to open the split section.

A hinge pin 20 is removed so that the door 18 can be swung open. Similarly the slip ring gate 70 is removed at a tongue in groove connection and the cover gate 74 is removed from the cover through disconnection of the guide ring 85. Thus, with the door, gates and slips in an open position, the mechanism 10 can be laterally moved from about the conduit 6.

Referring particularly to FIG. 8, as the yoke is pivoted with the handle moving downwardly, the pivot connection to the threaded stud 135 and notched locking rod 137 moves the locking rod downwardly further into the control slot 139. When the slips are in the down, engaged position, the grip 161 of the handle 159 is at an opposite end 173 of the arcuate slot 163 from an end 175 of the slot shown in FIG. 8. Accordingly, as the slips are raised and the locking rod 137 is moved downwardly into the control slot 139, movement of the handle toward the end 175 of the slot moves the finger 171 in the camming surface 199 of the locking cam 145 which then moves the locking cam in a clockwise direction until the locking key segment 143 of the locking cam seats in the notch 141 of the locking rod.

The camming surface 199 in the locking cam 145 allows a preselected degree of motion of the handle from either extreme position prior to application of force on the locking cam. This allows for a selected amount of inadvertent movement without affecting the locking assembly. The threaded connection between the threaded stud 135 and the locking rod 137 allows for proper adjustment to ensure desired positioning of the interacting components. It will also be apparent that the linear force applied upon the locking cam by the heavy spring 153 is greater than that applied by the light spring 169. The heavy spring is compressed at all times, exerting an outward or pushing force on the locking cam. In the position shown in FIG. 8, the force of the heavy spring tends to rotate the locking cam clockwise, thus forcing the key segment into the notch. The light spring is tensioned in the FIG. 8 configuration, exerting an inward or pulling force on the locking cam which also tends to rotate the locking cam clockwise.

When the handle is moved to the other end 173 of the slot, the force applied to the handle overcomes the force of the springs and causes the locking cam, as viewed in FIG. 8, to rotate counter clockwise. When the handle is so moved, the heavy spring 153 moves across a line joining a pivot point 177 at one end of the spring and the grease fitting 147 which is the pivot point of the locking cam. The spring 153 in that configuration thus exerts a counter clockwise force on the locking cam. The light spring 169 exerts a clockwise force in this orientation, which is insufficient to overcome the counter clockwise force of the heavy spring.

Thus, when the yoke handle is moved down, the slip ring and slips are moved up, the locking rod is moved down, and the handle is moved to interengage the locking cam and notch which locks the slips in the upper, disengaged position. When the handle is moved to disengage the locking cam from the notch, the force of gravity acting on the slips pulls the slips downward, the yoke pivots so that the handle moves upwardly, and the locking rod is raised upwardly and outwardly with respect to the control slot.

Lowering of the slips into gripped engagement with a conduit is substantially the reverse operation, with the downward and inward motion of the slips being assisted by gravity. The articulating interconnection of the components, the number of slips being three and being equally sized and distributed in a balanced fashion, together with the sliding cam surfaces, assures that the slip elements engage the conduit simultaneously and with an equal distribution of load on the conduit.

Figure 12:
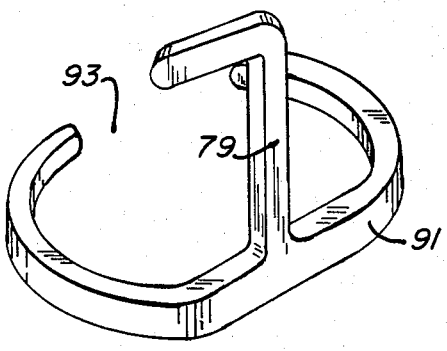
FIG. 12 is a perspective view of a foot actuating bar in accordance with the invention.

It will be apparent that for many applications, manual hand force will be sufficient to operate the engagement and disengagement of the slips. However, for other applications a power source, such as pneumatics or hydraulics, will be needed. Additionally, the pivoting force can be applied to the handle of the yoke in many manners, including insertion into the handle of a straight bar or a bar configured to extend downwardly and provide a foot actuating surface 91, such as the bar 79 shown in FIG. 12. The actuating surface 91 can be a ring extending about the body 12 and preferably having an opening 93 aligned with the split section 16.

Many modifications are possible without departing from the spirit and scope of the invention. It therefore is intended that all matter contained in the foregoing description and the drawings be interpreted as illustrative, and not in a limiting sense.

I claim:

1. A slip mechanism for gripping a conduit of circular cross section comprising:

a body having an internal bore and a split section open to said bore, said split section being at least as large as the outside diameter of said conduit;

a horizontally disposed, vertically movable ring above said body;

a rear slip and two side slips disposed at least partially within said bore, said rear slip being positioned opposite said split section, said slips each encompassing approximately a 120° arc;

means for articulatingly suspending said slips from said ring, said suspension means for said side slips including means for sliding said side slips in an arcuate path concentric with said bore upon raising of said ring, said sliding in an arcuate path being a distance sufficient to expose said split section; and means for selectively raising and lowering said ring.

2. The slip mechanism of claim 1 further comprising a door hingedly connected at each end of said door across said split section.

3. The slip mechanism of claim 2 wherein said ring comprises a gate generally coextensive with said split section, said gate being removable to expose a split segment in said ring.

4. The slip mechanism of claim 1 further comprising means for guiding said slips upwardly and radially outwardly upon said raising of said ring and for guiding said slips downwardly and radially inwardly upon said lowering of said ring.

5. The slip mechanism of claim 1 wherein a portion of the cross section of said ring is shaped generally as an inverted T.

6. The slip mechanism of claim 1 further comprising means for selectively locking said ring in a raised position.

7. The slip mechanism of claim 6 wherein said raising means comprise a pivoting beam and wherein said locking means comprise a rod interconnected to said beam and a biased cam cooperable with said rod to selectively fix said rod in position.

8. The slip mechanism of claim 7 further comprising means for adjusting the relative position of said beam and rod.

9. The slip mechanism of claim 1 wherein said selective raising means comprise a pivotable yoke having a force receiving end and a ring connection end, said ring connection end being connected to said ring through a cammed surface and said force receiving end being connectible to fluid powered means for pivoting said yoke.

10. The slip mechanism of claim 9 wherein said body further comprises means for attaching a split guide skirt to the bottom of said body, whereby said mechanism is useful as an elevator.

11. A slip mechanism for gripping a conduit of circular cross section comprising:

a generally channel shaped body defining therein a tapered vertical bore and having an open front section;

a door pivotally connected across said open front section;

a ring;

means for supporting said ring above said body;

a rear slip encompassing approximately a 120° arc positionable within said bore opposite said open front section;

means for articulatingly mounting said rear slip to said ring;

two side slips positionable within said bore, each said side slip encompassing approximately a 120° arc;

means for mounting said side slips to said ring for articulation relative to said ring and for sliding movement in an arcuate path concentric with said bore, said sliding arcuate movement being of sufficient distance to expose said open front section; and means for selectively lowering and raising said ring so as to simultaneously move said slips into and out of gripping engagement with said conduit.

12. The slip mechanism of claim 11 wherein said body further comprises means for attaching a split guide skirt to the bottom of said body, whereby said mechanism is useful as an elevator.

* * * * *